US005769594A

United States Patent [19]

Kalua

[11] Patent Number: 5,769,594

[45] Date of Patent: Jun. 23, 1998

[54] TRUCK MOUNTED, MULTI-LINK PICKUP ARM

[76] Inventor: John Kalua, P.O. Box 117, Nice, Calif. 95464

[21] Appl. No.: 556,297

[22] Filed: Oct. 6, 1995

[51] Int. Cl.[6] ..... B65F 3/02

[52] U.S. Cl. ..... 414/543; 414/408; 414/487; 414/550

[58] Field of Search ..... 414/408, 486, 414/487, 543, 547, 549, 550, 624; 901/15

[56] References Cited

U.S. PATENT DOCUMENTS

| | | | |
|---|---|---|---|
| 3,080,988 | 3/1963 | Redman | 414/624 |
| 3,762,586 | 10/1973 | Updike, Jr. | 414/408 |
| 3,765,554 | 10/1973 | Morrison | 414/500 X |
| 4,175,903 | 11/1979 | Carson | 414/408 |
| 4,828,453 | 5/1989 | Martin et al. | 901/15 X |
| 4,921,393 | 5/1990 | Andeen et al. | 901/21 X |
| 5,060,532 | 10/1991 | Barker | 901/15 X |
| 5,222,853 | 6/1993 | Carson | 414/408 |
| 5,330,308 | 7/1994 | Armando et al. | 414/408 |
| 5,391,039 | 2/1995 | Holton | 414/408 |
| 5,413,454 | 5/1995 | Mousesian | 901/15 X |
| 5,513,942 | 5/1996 | Pickrell | 414/408 X |
| 5,547,332 | 8/1996 | Smith et al. | 414/408 X |

FOREIGN PATENT DOCUMENTS

| | | | |
|---|---|---|---|
| 0225110 | 12/1962 | Austria | 414/486 |
| 1101386 | 7/1984 | U.S.S.R. | 414/408 |
| 1271802 | 11/1986 | U.S.S.R. | 414/408 |

*Primary Examiner*—James W. Keenan
*Attorney, Agent, or Firm*—Harris Zimmerman

[57] ABSTRACT

A truck-mounted pickup arm assembly for collecting, lifting, and placing objects and trash and recycling materials in the truck includes three boom sections to facilitate articulation of the arm in complex configurations to extend to the front or side of the truck, to reach over obstacles, and to pick up articles and materials and place them into a top loading opening in the truck. The pickup arm assembly includes a turntable mounted on the truck bed adjacent to and rearwardly of the truck cab. A main boom is pivotally secured to the turntable on a horizontal pivot axis, so that the main boom may pivot through approximately 180° in the space between the truck cab and the truck body. A coupling assembly is joined about one axis to the upper end of the main boom, and an intermediate boom is joined to the coupling about another, orthogonal axis. An outer boom is pivotally joined at one end in to a clevis end of the intermediate boom. A clamshell assembly is pivotally secured to the outer end of the outer boom. The turntable is power-driven, and all booms and the clamshell assembly are each manipulated by a power assist device. In a further embodiment, the turntable is supported on laterally extending rails or guides, so that the turntable may be translated laterally to either side of the truck bed. In another embodiment, a rail support extends longitudinally along the upper surface of the truck body and truck cab. A multi-boom pickup arm assembly is supported on a carriage that is adapted to travel along the rail support to permit the pickup arm assembly to engage objects and articles in the front or rear of the truck. In another aspect of the invention, a pickup arm assembly is supported by paired, laterally opposed arms pivotally joined on either side of the truck body to move the arm forwardly or rearwardly.

9 Claims, 5 Drawing Sheets

TRUCK MOUNTED, MULTI-LINK PICKUP ARM

BACKGROUND OF THE INVENTION

This invention relates to trash and materials handling, and more specifically to truck-mounted power equipment for lifting and collecting such materials.

In recent years, there has been an increasing awareness of the problems of waste disposal and a growing need for waste recycling. Almost all waste disposal sites are landfill operations that have a finite capacity, and many sites are approaching their limits. The determination of new landfill sites has been made more difficult in recent years by the imposition of environmental reviews, environmental impact statements, local and regional legislation, and the legitimate concerns of neighboring residents. As a result, the number of landfill operations for waste disposal has diminished, and the cost of disposal has increased correspondingly.

It is clear that the optimal method for dealing with waste products is to recycle these materials process these substances to form a useful material. Indeed, the only distinction between waste products and raw materials is that no useful purpose has been identified for the waste products. It is a truism that "pollution is a resource out of place." Many toxic byproducts are no more harmful than virgin raw materials used for various industrial purposes, yet the need to dispose of the "toxic byproducts" causes tremendous problems for manufacturers and industrial processors.

Waste recycling has become a growing business, providing employment for many individuals while creating, sources of raw materials for industry. Recycling generally requires more handling and sorting of materials than mere bulk trash hauling and disposal, although these activities are often intermingled. Much of the labor involves lifting, carrying, and sorting loads that are at the upper limit of human capacity. Unfortunately, the prior art is deficient in devices for easing the burden of this type of labor. Equipment for trash collection and hauling typically comprises collection trucks having power-assisted lifting devices designed for lifting and emptying large coffer-like containers (e.g., "dumpsters") that have previously been filled. For tasks involving picking up loose articles and objects such as tires, lumber, tree limbs, etc., or trash items that have not been or cannot be placed in large containers, there are available no power-assisted devices to ease the human burden of lifting and carrying. Thus, for tasks such as collecting loose materials at curbside pickup, cleanup of highway right of way, cleanup of industrial or construction sites, and the like, there is little help for the manual laborer.

This problem has been exacerbated by developments in laws and regulations regarding workers compensation and disability. Injuries to laborers from handling heavy loads may result in long-term disability compensation, and such costs must be factored into the economics of trash hauling and waste recycling. It is clear that mechanical assistance for heavy labor can be a sound business decision in the long term, due to the human and economic toll of such heavy labor.

SUMMARY OF THE INVENTION

The present invention generally comprises a truck-mounted pickup arm assembly for collecting, lifting, and placing objects and trash and recycling materials in the truck. A salient feature of the invention is that the pickup arm includes three boom sections to facilitate articulation of the arm in complex configurations to extend to the front or side of the truck, to reach over obstacles such as highway guard rails, and to pick up articles and materials and place them into a top loading opening in the truck. A further feature is that the pickup arm assembly is mounted on the truck bed between the truck cab and the truck load body, and that it may be automatically stowed in a folded configuration to permit the truck to travel at highway speeds without hindrance.

The pickup arm assembly includes a turntable mounted on the truck bed adjacent to and rearwardly of the truck cab. A main boom is pivotally secured to the turntable on a horizontal pivot axis, so that the main boom may pivot through approximately 180° in the space between the truck cab and the truck body. Joined to the upper end of the main boom is a coupling assembly having two axes of rotation. The coupling is joined about one axis to the upper end of the main boom, and an intermediate boom is joined to the coupling about the other, orthogonal axis. The outer end of the intermediate boom includes a clevis configuration, and an outer boom is pivotally joined at one end in the clevis of the intermediate boom. The outer boom includes a dogleg configuration at each end to provide clearance with the other booms. A pickup device such as a clamshell assembly is pivotally secured to the outer end of the outer boom.

The turntable is power-driven, and the conjunctions of the main boom and the coupling assembly, the coupling assembly and the intermediate boom, the intermediate boom and the outer boom, and the clamshell assembly are each manipulated by a power assist device such as hydraulic or pneumatic cylinders, electric or hydraulic motors, or cable and pulley arrangements, as are known in the prior art, to control articulation of the components. In the preferred embodiment the booms may be fully extended to engage and lift a 100 lb. load to the top opening of the truck load body. Moreover, microprocessor control permits automatic deployment and stowing of the pickup arm assembly, and prevents articulations that cause the pickup arm components to impinge on any portion of the truck cab or body.

The pickup arm may be stowed with the main boom upright, the intermediate boom extending generally horizontally from the coupling assembly, and the outer boom extending generally horizontally and parallel to the intermediate boom, with the clamshell assembly disposed adjacent to the coupling assembly. All components are nested and located inboard of the truck body and truck cab.

With the main boom extended horizontally to the side of the truck, the intermediate boom may be disposed generally vertically, and the outer boom may extend from the upper end of the intermediate boom for pickup tasks. The intermediate boom may also be extended at an oblique angle with respect to the main boom to reach along the side of the truck, either forward or rearward.

In a further embodiment, the turntable is supported on laterally extending rails or guides, so that the turntable may be translated laterally to either side of the truck bed. This feature permits increased range and extension of the pickup arm to the front, sides, and rear of the truck.

In another embodiment, a rail support extends longitudinally along the upper surface of the truck body and truck cab. A multi-boom pickup arm assembly is supported on a carriage that is adapted to travel along the rail support. The carriage may be translated forwardly to permit the pickup arm assembly to engage and lift objects and articles in front of the truck. The carriage may be translated rearwardly, so that the pickup arm assembly may deposit the articles into an upper opening in the truck body. Likewise, the carriage may pivot to permit the pickup arm assembly to engage objects or articles to the side or rear of the truck.

In yet another embodiment of the invention, a pickup arm assembly is secured to a base that is supported by paired, laterally opposed arms pivotally joined on either side of the truck body. The arms are hydraulically or pneumatically actuated to rotate from a forward position in which the base is disposed superjacent to the truck cab, to a rear position in which the base is disposed adjacent to the rear of the truck body. The pickup arm assembly is rotatably supported on the base, so that the pickup arm may be extended in front of the truck cab or to the rear of the truck body for pickup and collection purposes.

DESCRIPTION OF THE PREFERRED EMBODIMENT

Figure 1:
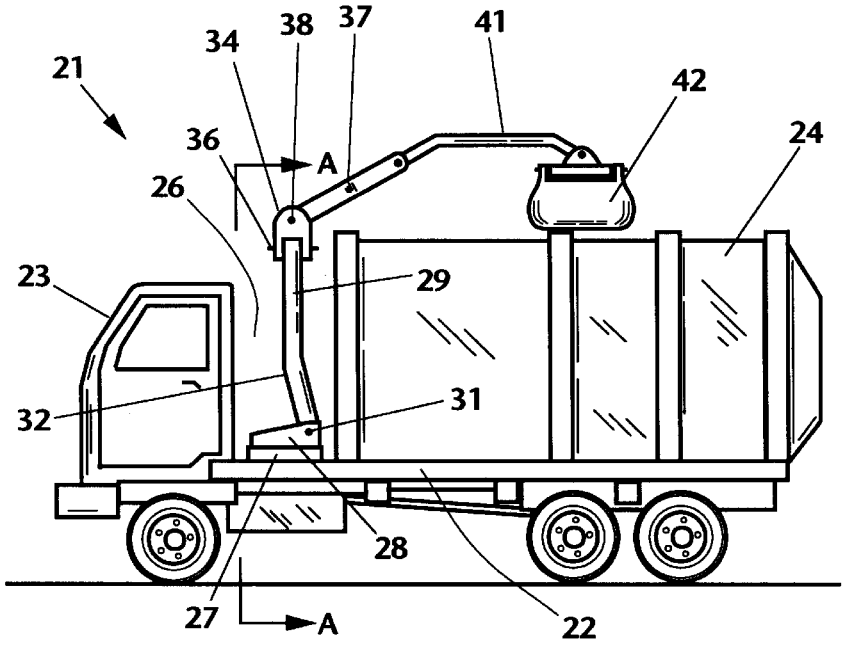
FIG. 1 is a side elevation of the truck-mounted pickup arm assembly of the present invention.

The present invention generally comprises a truck-mounted pickup arm assembly for collecting, lifting, and placing objects, articles, trash and recycling materials in the truck. With regard to FIG. 1, a truck 21 includes a truck bed 22 having a driver's cab 23 at the forward end, and a truck body 24 supported on medial and rear portions of the truck bed. The truck body 24 is depicted as a typical trash collection body having a top loading opening 25 (FIG. 5), although other body types and a flatbed arrangement may also be used. An open space 26 is defined between the rear of the cab 23 and the front of the truck body 24, the space 26 extending laterally to open to both sides of the truck 21.

Figure 2:
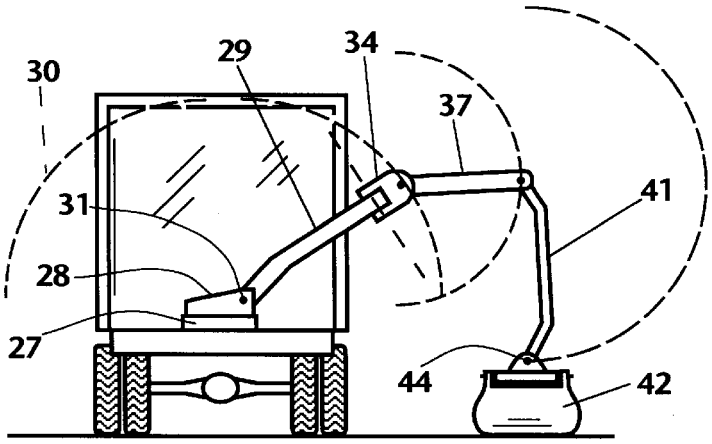
FIG. 2 is a front elevation taken along line A—A, depicting the side extension possibilities of the pickup arm assembly of the invention.

Referring additionally to FIG. 2, the pickup arm assembly includes a turntable 27 supported on the truck bed 22 and disposed medially in the open space 26 of the truck. The turntable 27 includes spaced apart side supports 28. A main boom 29 includes a proximal end disposed between the supports 28 and secured therebetween by a pivot shaft 31. A power articulation device (not shown), which may comprise hydraulic or pneumatic cylinders, electric, hydraulic, or pneumatic motor drives, or cable and pulley drives is connected between the turntable 27 and the main boom to selectively pivot the main boom 29 through an arc 30 from one side to a neutral vertical orientation to the other side of the truck 21. The main boom 29 generally comprises a tubular strut having a slight dogleg configuration 32 at the lower portion thereof, so that although the proximal end of the main boom is eccentric to the axis of the turntable 27, the majority of the main boom may be disposed generally coaxially with the turntable when the main boom is extended fully vertically.

Secured to the distal end of the main boom is a coupling joint assembly 34, which is a two axis coupling. The distal end of the main boom is joined by a pivot shaft 36 to one side of the coupling, and an intermediate boom 37 is joined at a proximal end to the other side of the coupling by a pivot shaft 38. The axes of the shafts 36 and 38 extend generally orthogonally, and the axes of pivot shafts 31 and 38 are generally disposed in a common plane, regardless of the articulation about the pivot shaft 36. This factor permits many utilitarian articulations of the pickup arm assembly, as will be detailed in the following description.

The intermediate boom includes a clevis configuration 39 at the distal end thereof. An outer boom 41 is provided with a double-end dogleg configuration to provide clearance with the other booms and with a clamshell unit 42 secured to the distal end of the outer boom. The proximal end of the boom 41 is joined in the clevis end 39 of boom 37 by a pivot shaft 43, and a pivot shaft 44 joins the distal end of the outer boom to the clamshell unit 42. The two shafts 43 and 44 extend along generally parallel axes, which are parallel to the shaft 38.

Figure 5:
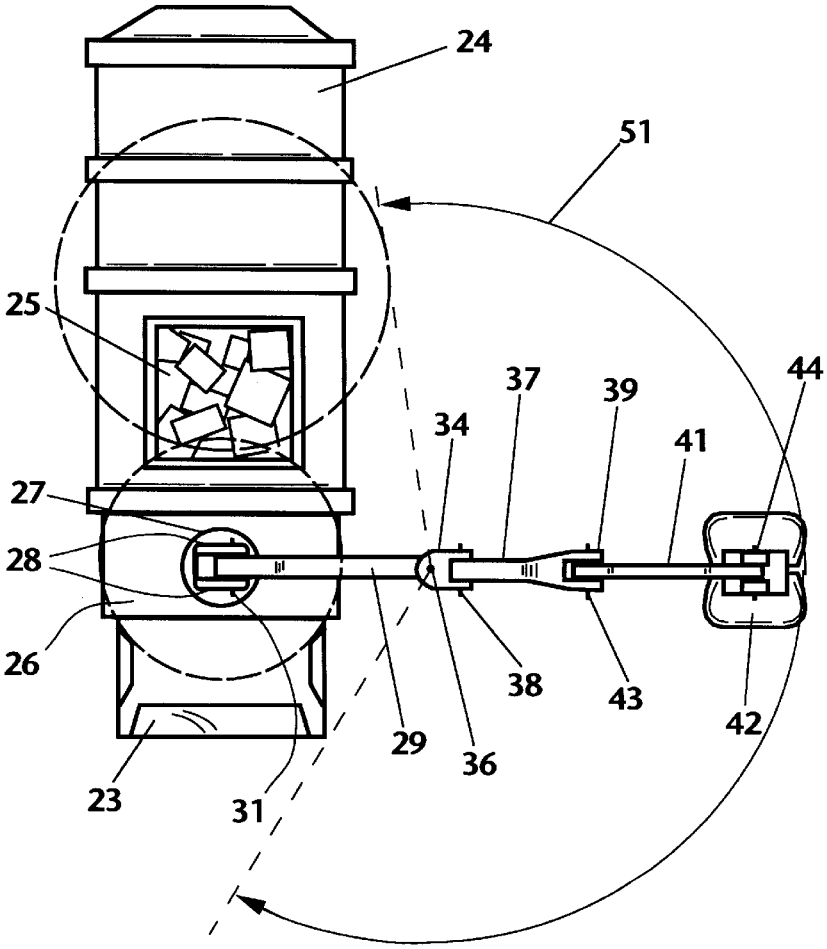
FIG. 5 is a plan view of the truck-mounted pickup arm assembly, depicting the limits of extension of the pickup arm.

With the turntable 27 angularly positioned so that the main boom may be rotated laterally downwardly in the space 26, the booms may be extended in general alignment, as shown in FIG. 5, to extend the pickup arm assembly maximally to the side of the truck 21. This configuration provides an extended reach for picking up objects and articles that cannot be approached proximately by the truck. For example, the pickup arm assembly may be extended over highway guard rails for road cleanup tasks. Moreover, the intermediate and outer booms may be pivoted about the shaft 36 to extend forwardly of the truck cab 23 and rearwardly of the opening 26 to move the clamshell 42 within and along trajectory 51. Thus a large area may be covered by the pickup arm.

Figure 3:
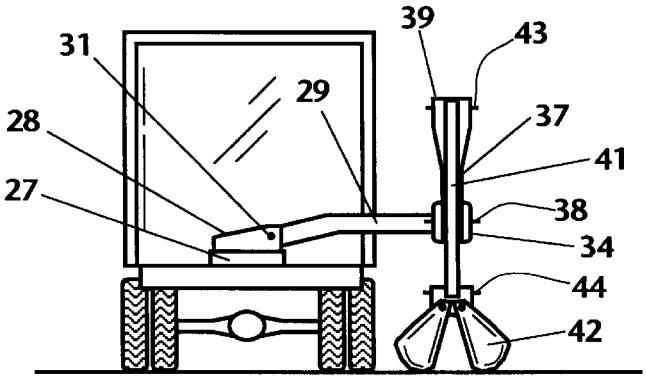
FIG. 3 is a front elevation taken along line A—A, depicting further side extension possibilities of the pickup arm assembly of the invention.
Figure 4:
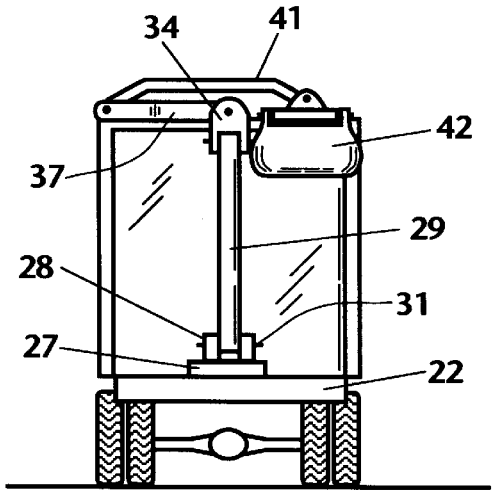
FIG. 4 is a front elevation taken along line A—A, depicting the stowed configuration of the pickup arm assembly of the invention.

In addition, as shown in FIG. 3, the main boom may be disposed generally horizontally, the intermediate boom 37 may be pivoted to extend generally upwardly from coupling 34, and the outer boom may be disposed to extend downwardly directly adjacent to the side of the truck 21. This articulation provides access to objects and article close to the truck. With reference to FIG. 4, the pickup arm assembly may be stowed for truck travel by placing the main boom 29 in a vertical orientation, the intermediate boom 37 in a horizontal disposition extending to one side of the truck, and the outer boom 41 extending generally horizontally above the boom 37 to dispose the clamshell assembly 42 adjacent to the coupling joint 34. This configuration places the entire assembly inboard of the truck, and centers the mass of the pickup arm with respect to the turntable and the truck centerline, providing safe travel even at highway speeds. It may be appreciated that the pickup arm assembly may be articulated between any of the dispositions of FIGS. 2–5, and to extend in the disposition of FIG. 1 wherein an object or article may be deposited in the upper opening 25 of the truck body.

Figure 6:
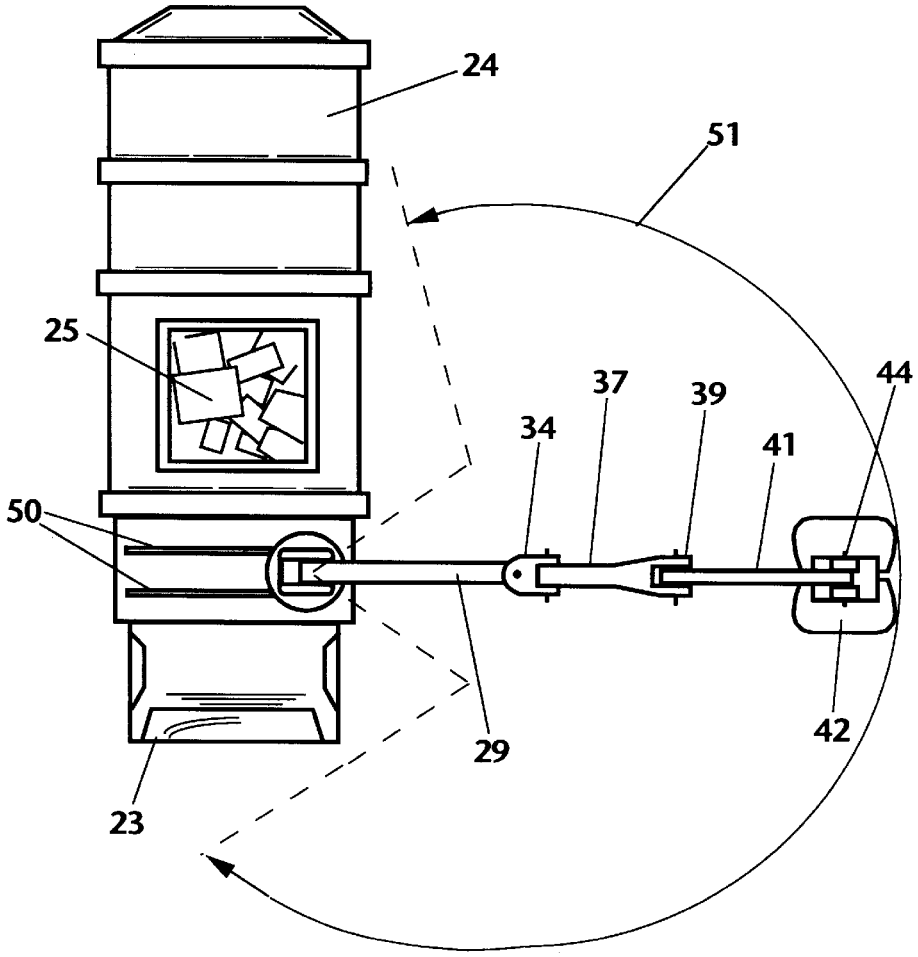
FIG. 6 is a plan view of a further embodiment of the truck-mounted pickup arm assembly in which the pickup arm is translatably mounted on a lateral rail guide on the truck bed.

With regard to FIG. 6, a further embodiment of the invention comprises the pickup arm assembly essentially as described above. In addition, the truck bed is provided with a rail guide 50 extending laterally in the open space 26 between the truck cab and body. The turntable 27 is supported on the rail guide in translatable fashion, and a power drive (chain, gear, hydraulic, pneumatic, or the like) is provided to selectively position the turntable along the rail guide 50. Positioning the turntable laterally outwardly on the rail guide 50 permits greater lateral pickup range for the arm assembly, and also permits greater extension forwardly of the truck cab and rearwardly as well.

In the embodiments depicted in FIGS. 1–6, the pickup arm assembly is designed to lift a minimum load of 100 lb. from the ground and place it into the opening 25. Although the ranges of articulation are depicted to one side of the truck, it is clear that the invention is bilaterally symmetrical, and that the same articulations may be accomplished to the opposite side of the truck. The pickup arm articulations may be controlled by a microprocessor, and which may be programmed with any combination of articulations of the booms that causes any portion of the assembly to impact on the truck. In addition, deployment and stowing may be carried out automatically to improve overall operating efficiency.

Figure 11:
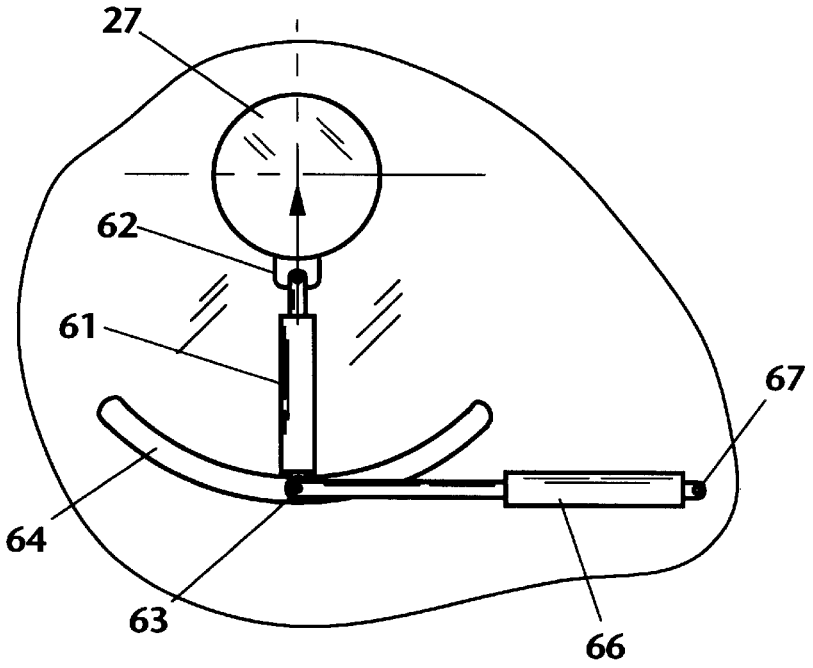
FIG. 11 is a bottom plan view of one mechanism for rotating the turntable of the pickup arm, shown in a dead-center position.
Figure 12:
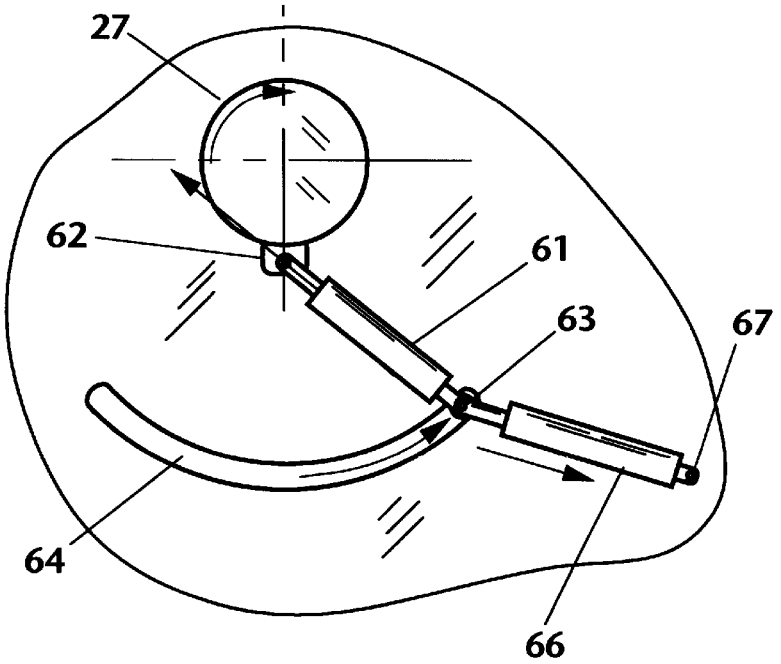
FIG. 12 is a view as in FIG. 11, showing the turntable rotated by the mechanism.

With regard to FIGS. 11 and 12, one mechanism for rotating the turntable 27 includes a pneumatic or hydraulic cylinder 61 having one end pivotally secured to a lug 62 extending from the turntable 27. The other end of the cylinder is connected to a pin 63 that is disposed to translate within an arcuate slot 64 disposed adjacent to the turntable 27, the slot 64 being generally concentric with the turntable. Another pneumatic or hydraulic cylinder 66 includes one end secured to the pin 63, with the other end of cylinder 66 pivotally joined to a fixed anchor 67. The cylinders 61 and 66 are independently actuable.

Referring to FIG. 11, the cylinder 61 can arrive in a position in which it is oriented radially with respect to the turntable 27, and is thereby unable to apply an eccentric force to the lug 62. In such circumstance, the cylinder 66 may be retracted, as shown in FIG. 12, to orient the cylinder 61 eccentrically to permit the cylinder 61 to apply a tangential force to the turntable for rotation thereof. Likewise, the cylinder 66 may be extended to drive the pin 63 to translate to any position in the slot 64 to prevent a dead-center stall of the rotation mechanism.

The turntable rotation arrangement of FIGS. 11 and 12 may also be applied directly to the main boom to effect rotation of the pickup arm assembly.

Figure 7:
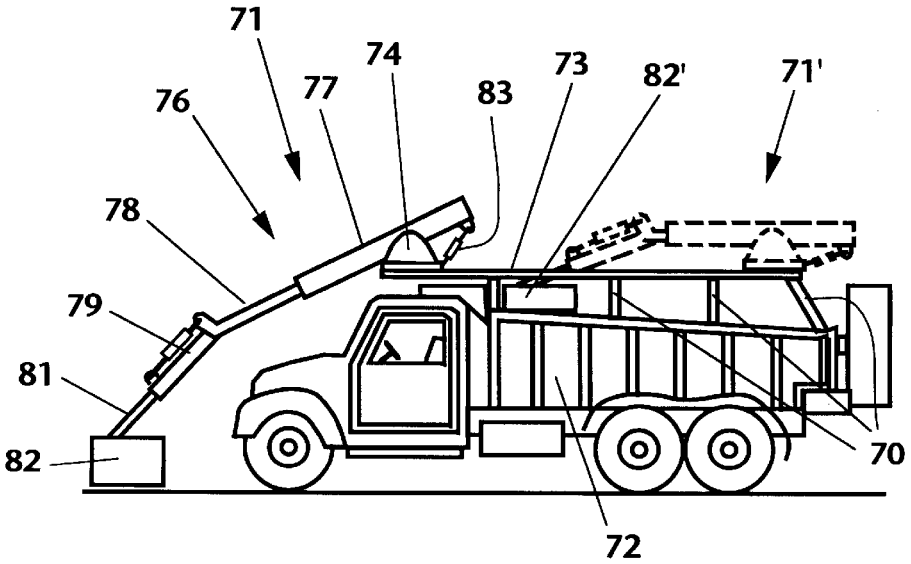
FIG. 7 is a side elevation of another embodiment of the truck-mounted pickup arm assembly, in which the pickup arm is translatably mounted on a longitudinally extending rail guide on the truck body.

With regard to FIG. 7, a further embodiment of the invention includes a truck 71 having a dump truck body 72. A rail assembly 73 is disposed superjacently to the body 73 and supported by a plurality of struts 70 extending upwardly from the body 73. A pickup arm assembly 76 includes a carriage 74 secured to the rail assembly in translatable fashion and arranged to support a telescoping hydraulic cylinder assembly 77 in pivoting fashion. The piston rod 78 of cylinder 77 is pivotally joined to another telescoping hydraulic cylinder assembly 79, the piston rod 81 of which includes means for grasping and lifting a collection box 82 or the like. A further telescoping hydraulic unit 83 extends from the rear end of the cylinder assembly 77 to the carriage 74 to raise and lower the pickup arm assembly.

As shown in FIG. 7, the pickup arm assembly 76 may be advanced on the rail assembly 73 and extended and lowered to grasp and lift objects or collection boxes disposed directly in front of the truck 71. Retraction of the unit 83 lifts the assembly and the article 82, and the carriage 74 may be translated rearwardly to the position indicated at 71', so that the article 82' may be emptied (or deposited) into a top opening of the dump truck body. It may be appreciated that the distal end of the piston rod 81 may alternatively be provided with a clamshell assembly or the like, as in the previous embodiment, to handle loose articles.

Figure 8:
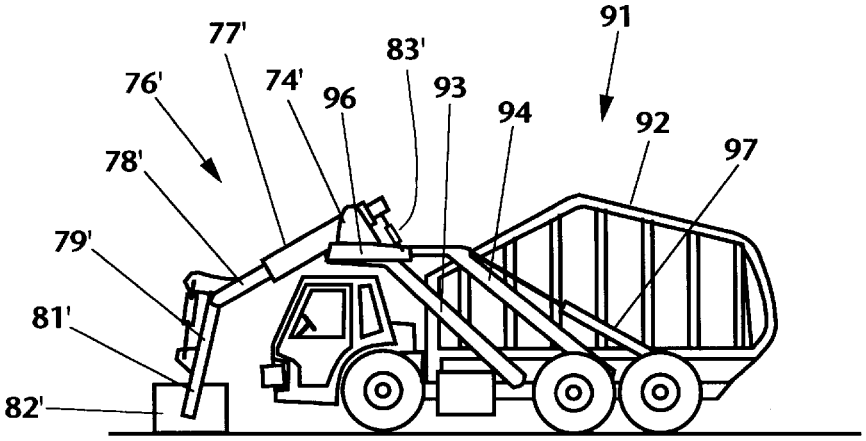
FIG. 8 is a side elevation of a further embodiment of the truck-mounted pickup arm assembly, in which the pickup arm is mounted on laterally opposed, paired support legs, shown with the support legs in the forward-most position.
Figure 9:
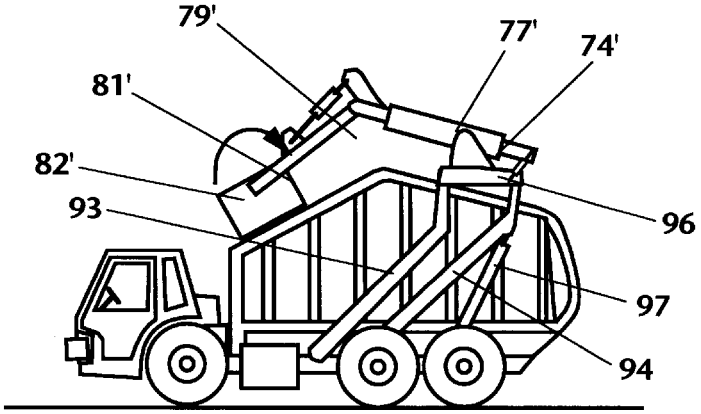
FIG. 9 is a side elevation of the embodiment of FIG. 8, shown with the support legs disposed rearwardly and the pickup arm disposed to deposit articles into the truck body.
Figure 10:
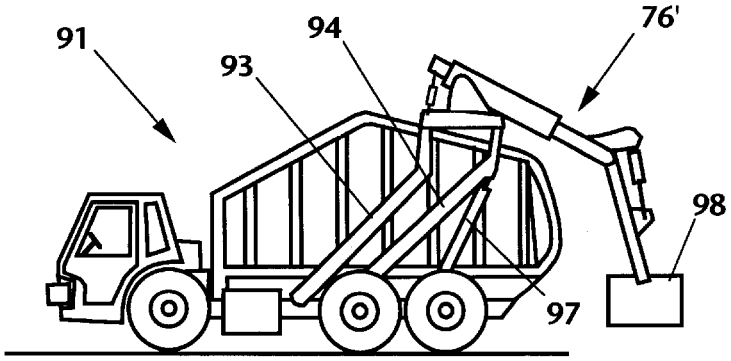
FIG. 10 is a side elevation of the embodiment of FIG. 8, shown with the support legs disposed rearwardly and the pickup arm disposed to extend to retrieve articles to the rear of the truck.

Referring to FIGS. 8–10, another embodiment of the invention comprises a collection truck 91 having a refuse collection body 92. Laterally opposed pairs of legs 93 and 94 are pivotally secured at like lower ends to a medial portion of each side of the truck bed or like structure. A support base 96 is pivotally secured to the upper ends of the legs 93 and 94, and a pair of laterally opposed hydraulic or pneumatic cylinder assemblies 97 are pivotally connected between the support base and a rear portion of the truck bed or like structure. The cylinder assemblies may be telescoped to rotate the legs 93 and 94 to extend forwardly, as in FIG. 8, to place the support base 96 in a horizontal disposition superjacent to the truck cab, or retracted, as in FIGS. 9 and 10, to place the support base 96 in a horizontal disposition superjacent to the rear portion of the truck body 92.

Secured to the support base 96 is a pickup arm assembly 76' which is rotatable about a vertical axis. The assembly 76' includes essentially the same components as in the embodiment of FIG. 7, and these components are labeled with the same reference numerals bearing a prime (') designation. In the forward position illustrated in FIG. 8, the pickup arm assembly 76' may be articulated downwardly to grasp and lift a collection box 82' or the like. After lifting the box 82', the cylinder assemblies 97 may be retracted to move the support base rearwardly, as shown in FIG. 9. (The pantographic relationship of the legs 93 and 94 with the support base assure that the support base remains generally horizontal.) This motion places the collection box 82' over the top loading opening of the truck body 92, and the box may be emptied into the opening.

In addition, the pickup arm assembly 76' may be rotated about a vertical axis through the support base 96, so that the pickup arm extends rearwardly of the truck, as shown in FIG. 10. In this disposition, the pickup arm may grasp and lift a collection box 98 or the like, rotate forwardly, and empty the box 98 into the truck. Thus the embodiment of FIGS. 8–10 permits handling of trash and recycling collection from the front or rear of the truck without manual effort.

All of the embodiments disclosed herein may be employed equally effectively to off-load articles and objects from a truck to areas adjacent thereto.

The foregoing description of the preferred embodiment of the invention has been presented for purposes of illustration and description. It is not intended to be exhaustive or to limit the invention to the precise form disclosed, and many modifications and variations are possible in light of the above teaching without deviating from the spirit and the scope of the invention. The embodiments described are selected to best explain the principles of the invention and its practical application to thereby enable others skilled in the art to best utilize the invention in various embodiments and with various modifications as suited to the particular purpose contemplated. Various features of the different embodiments may be combined, although not specifically disclosed herein, without departing from the spirit of the invention. It is intended that the scope of the invention be defined by the claims appended hereto.

I claim:

1. A truck-mounted pickup arm assembly, including;

a support base including a turntable, and means for rotating said turntable about a vertical axis;

a main boom having a lower end and an upper end, and first means for joining said lower end of said main boom to said support base for pivoting movement about a first axis;

a coupling joint assembly, and second means for joining said upper end of said main boom to said coupling joint assembly for pivoting movement about a second axis;

an intermediate boom having a proximal end and a distal end, and third means for joining said proximal end of said intermediate boom to said coupling joint assembly for pivoting movement about a third axis;

an outer boom having a proximal end and an outer end, and fourth means for joining said proximal end of said outer boom to said distal end of said intermediate boom for pivoting movement about a fourth axis;

means secured to said distal end of said outer boom for grasping and lifting articles and objects; and means for articulating said main boom about said first axis, said intermediate boom about said second and third axes, and said outer boom about said fourth axis;

said second axis extending generally orthogonally with respect to said first axis, and said third axis extending generally parallel to said first axis.

2. The truck-mounted pickup arm assembly of claim 1, wherein said third axis and said fourth axis are generally parallel.

3. The truck-mounted pickup arm assembly of claim 1, wherein said means for rotating said turntable includes a first telescoping assembly, and means for connecting one end of said first telescoping assembly to a peripheral portion of said turntable.

4. The truck-mounted pickup arm assembly of claim 1, wherein said first axis is orthogonal to said vertical axis of said turntable.

5. The truck-mounted pickup arm assembly of claim 1, wherein said means for grasping and lifting includes a clamshell assembly, and further including fifth means for joining said clamshell assembly to said distal end of said outer boom for pivoting movement about a fifth axis.

6. The truck-mounted pickup arm assembly of claim 1, wherein said third means includes a clevis formed in said distal end of said intermediate boom, said proximal end of said outer boom received within said clevis for pivotal motion therein.

7. A truck-mounted pickup arm assembly, including:

a support base;

a main boom having a lower end and an upper end, and first means for joining said lower end of said main boom to said support base for pivoting movement about a first axis;

a coupling joint assembly, and second means for joining said upper end of said main boom to said coupling joint assembly for pivoting movement about a second axis;

an intermediate boom having a proximal end and a distal end, and third means for joining said proximal end of said intermediate boom to said coupling joint assembly for pivoting movement about a third axis;

an outer boom having a proximal end and an outer end, and fourth means for joining said proximal end of said outer boom to said distal end of said intermediate boom for pivoting movement about a fourth axis;

means secured to said distal end of said outer boom for grasping and lifting articles and objects;

means for articulating said main boom about said first axis, said intermediate boom about said second and third axes, and said outer boom about said fourth axis;

said support base comprising a turntable, and means for rotating said turntable about a vertical axis;

said means for rotating said turntable including a first telescoping assembly, and means for connecting one end of said first telescoping assembly to a peripheral portion of said turntable;

a pin disposed to translate within an arcuate slot, and means for connecting the other end of said first telescoping assembly to said pin.

8. The truck-mounted pickup arm assembly of claim 7, further including second telescoping means having one end connected to said pin and another end connected to a fixed anchor, said second telescoping means disposed to translate said pin along said arcuate slot.

9. A truck-mounted pickup arm assembly, including;

a support base including a turntable, and means for rotating said turntable about a vertical axis;

rail guide means for supporting said turntable in laterally translatable fashion;

a main boom having a lower end and an upper end, and first means for joining said lower end of said main boom to said turntable for pivoting movement about a first axis;

a coupling joint assembly, and second means for joining said upper end of said main boom to said coupling joint assembly for pivoting movement about a second axis;

an intermediate boom having a proximal end and a distal end, and third means for joining said proximal end of said intermediate boom to said coupling joint assembly for pivoting movement about a third axis;

an outer boom having a proximal end and an outer end, and fourth means for joining said proximal end of said outer boom to said distal end of said intermediate boom for pivoting movement about a fourth axis;

means secured to said distal end of said outer boom for grasping and lifting articles and objects; and means for articulating said main boom about said first axis, said intermediate boom about said second and third axes, and said outer boom about said fourth axis.

* * * * *